US008041053B2

(12) United States Patent
Kobayashi et al.

(10) Patent No.: US 8,041,053 B2
(45) Date of Patent: Oct. 18, 2011

(54) VEHICULAR SOUND EFFECT GENERATING APPARATUS

(75) Inventors: Yasunori Kobayashi, Utsunomiya-shi (JP); Toshio Inoue, Tochigi-ken (JP); Akira Takahashi, Tochigi-ken (JP); Kosuke Sakamoto, Utsunomiya-shi (JP)

(73) Assignee: Honda Motor Co., Ltd., Tokyo (JP)

( * ) Notice: Subject to any disclaimer, the term of this patent is extended or adjusted under 35 U.S.C. 154(b) by 1240 days.

(21) Appl. No.: 11/727,239

(22) Filed: Mar. 26, 2007

(65) Prior Publication Data

US 2007/0234879 A1 Oct. 11, 2007

(30) Foreign Application Priority Data

Mar. 27, 2006 (JP) ..... 2006-086511

(51) Int. Cl.
*H04B 1/00* (2006.01)

(52) U.S. Cl. ..... 381/86

(58) Field of Classification Search ..... None
See application file for complete search history.

(56) References Cited

U.S. PATENT DOCUMENTS 5,835,605 A 11/1998 Kunimoto
6,014,447 A * 1/2000 Kohnen et al. ..... 381/86
6,275,590 B1 * 8/2001 Prus ..... 381/61
7,088,829 B1 * 8/2006 Schick et al. ..... 381/71.4

FOREIGN PATENT DOCUMENTS

| | | | |
|---|---|---|---|
| JP | 54-8027 | | 1/1979 |
| JP | 4-504916 | A | 8/1992 |
| JP | 05-080790 | A | 4/1993 |
| JP | 8-152894 | A | 11/1996 |
| JP | 2007-256841 | A | 10/2007 |
| WO | 90/13109 | A1 | 11/1990 |

* cited by examiner

*Primary Examiner* — Vivian Chin
*Assistant Examiner* — Kile Blair
(74) *Attorney, Agent, or Firm* — Arent Fox LLP

(57) ABSTRACT

A vehicular sound effect generating apparatus has a controller for determining whether a transmission on a vehicle is a manual transmission or an automatic transmission based on whether a clutch signal is generated or not, and automatically changing weighting gain characteristics as acoustic correcting characteristics stored in a sound pressure adjuster depending on the determined transmission. The vehicular sound effect generating apparatus generates a sound effect in a vehicle cabin depending on the manual transmission or the automatic transmission.

5 Claims, 9 Drawing Sheets

16

| ADDRESS | WAVEFORM DATA |
|---|---|
| 0 | 0 |
| 1 | $A\sin(360° \times \frac{1}{N})$ |
| ... | ... |
| i | $A\sin(360° \times \frac{i}{N})$ |
| ... | ... |
| N | $A\sin(360° \times \frac{N-1}{N})$ |

AT VEHICLE

VEHICULAR SOUND EFFECT GENERATING APPARATUS

CROSS-REFERENCE TO RELATED APPLICATION

This application claims the priority of JP Application No. 2006-086511, filed Mar. 27, 2006, the entire specification, claims and drawings of which are incorporated herewith by reference.

BACKGROUND OF THE INVENTION

1. Field of the Invention:

The present invention relates to a vehicular sound effect generating apparatus for generating a sound effect depending on the rotational speed of the engine on a motor vehicle in the passenger compartment of the motor vehicle.

2. Description of the Related Art:

Heretofore, there have been proposed in the art sound effect producing apparatus for detecting an accelerating or decelerating action made by the driver of a motor vehicle, and producing and radiating a sound effect depending on the acceleration or deceleration through a speaker installed in a motor vehicle cabin into the vehicle cabin, as disclosed in Japanese Laid-Open Patent Publication No. 54-8027 and Japanese Laid-Open Patent Publication No. 4-504916 (PCT Application).

According to the disclosed sound effect producing apparatus, for example, when the rotational speed of the engine mounted on the motor vehicle increases in response to an accelerating action made by the driver, a sound effect having a high frequency and a large sound level is generated depending on the increase in the engine rotational speed and radiated from the speaker into the vehicle cabin to create a staged sound atmosphere in the vehicle cabin.

It is known in the art that a motor vehicle having a manual transmission with stepwise gear ratios and a motor vehicle having an automatic transmission with stepwise gear ratios, even if the motor vehicles are of the same type, have different time-dependent changes in the engine rotational speed for full throttle opening, i.e., different rotational frequency changes [Hz/sec], at each of gear ratios for first, second, third, and fourth gear positions. It is also known in the art that a motor vehicle powered by an engine with a manual transmission and a motor vehicle powered by an engine of the same type with an automatic transmission have different rotational frequency changes in the same gear position.

For example, on a motor vehicle powered by a six-cylinder engine with a manual transmission (MT motor vehicle) shown in FIG. 8 of the accompanying drawings, the rotational frequency change is 31 [Hz/sec] in the first gear position, 16 [Hz/sec] in the second gear position, 7 [Hz/sec] in the third gear position, and 3.7 [Hz/sec] in the fourth gear position. On a motor vehicle powered by a six-cylinder engine with an automatic transmission (AT motor vehicle) shown in FIG. 9 of the accompanying drawings, the rotational frequency change is 19 [Hz/sec] in the first gear position, 7.7 [Hz/sec] in the second gear position, 2.9 [Hz/sec] in the third gear position, and 0.83 [Hz/sec] in the fourth gear position.

However, the above conventional sound effect generating apparatus for generating a sound effect for vehicles fail to disclose or teach anything about the generation of a sound effect in relation to a manual transmission or an automatic transmission.

SUMMARY OF THE INVENTION

It is an object of the present invention to provide a vehicular sound effect generating apparatus for generating a sound effect in the passenger compartment of a motor vehicle differently depending on whether the motor vehicle has a manual transmission or an automatic transmission.

According to the present invention, a vehicular sound effect generating apparatus includes a waveform data table for storing waveform data in one cyclic period, a reference signal generating means for generating a reference signal by successively reading the waveform data from the waveform data table, a running state detecting means for detecting a running state of a vehicle, a control means having an acoustic correcting means having acoustic correcting characteristics depending on the running state of the vehicle, for generating a control signal by using the acoustic correcting means by acoustically changing the reference signal depending on the running state of the vehicle detected by the running state detecting means, an output means for outputting the control signal as a sound effect, and a transmission determining means for determining whether a transmission on the vehicle is a manual transmission or an automatic transmission, wherein the control means changes the acoustic correcting characteristics of the acoustic correcting means depending on the transmission determined by the transmission determining means.

With the above arrangement, since the control means changes the acoustic correcting characteristics depending on whether the transmission on the vehicle is a manual transmission or an automatic transmission as determined by the transmission determining means, the vehicular sound effect generating apparatus can generate an appropriate sound effect depending on the running state of the vehicle equipped with the manual transmission or the automatic transmission.

The running state of the vehicle may comprise an engine rotation frequency change, and the acoustic correcting characteristics may comprise output gain characteristics corresponding to the engine rotation frequency change. When the engine rotation frequency change exceeds a predetermined threshold, the output gain characteristics for the manual transmission may be set to values greater than the output gain characteristics for the automatic transmission.

When the engine rotation frequency change is greater than the predetermined threshold, the output gain characteristic for the manual transmission are set to values greater than the output gain characteristics for the automatic transmission. Consequently, when the engine rotation frequency change is greater than the predetermined threshold, a MT vehicle with the manual transmission can generate a larger sound effect in a vehicle cabin than an AT vehicle with the automatic transmission.

According to the present invention, since the acoustic correcting characteristics are changed depending on whether the transmission on the vehicle is a manual transmission or an automatic transmission as determined by the transmission determining means, the vehicular sound effect generating apparatus can generate an appropriate sound effect depending on the manual transmission or the automatic transmission.

As a sound effect depending on the transmission is generated on the MT vehicle with the manual transmission or the AT vehicle with the automatic transmission, the sound effect does not make the passengers on the vehicle feel odd about the sound effect.

According to the present invention, furthermore, since the acoustic correcting characteristics such as output gain characteristics can be changed by software, the MT vehicle and the AT vehicle can use the vehicular sound effect generating apparatus of the same hardware structure, rather than different vehicular sound effect generating apparatus designed respectively for the MT vehicle and the AT vehicle. Therefore, the vehicular sound effect generating apparatus can efficiently be mass-produced, and can be manufactured at a low cost. The vehicle which incorporates the vehicular sound effect generating apparatus can also be manufactured at a low cost.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

An embodiment of the present invention will be described below with reference to the drawings.

Figure 1:
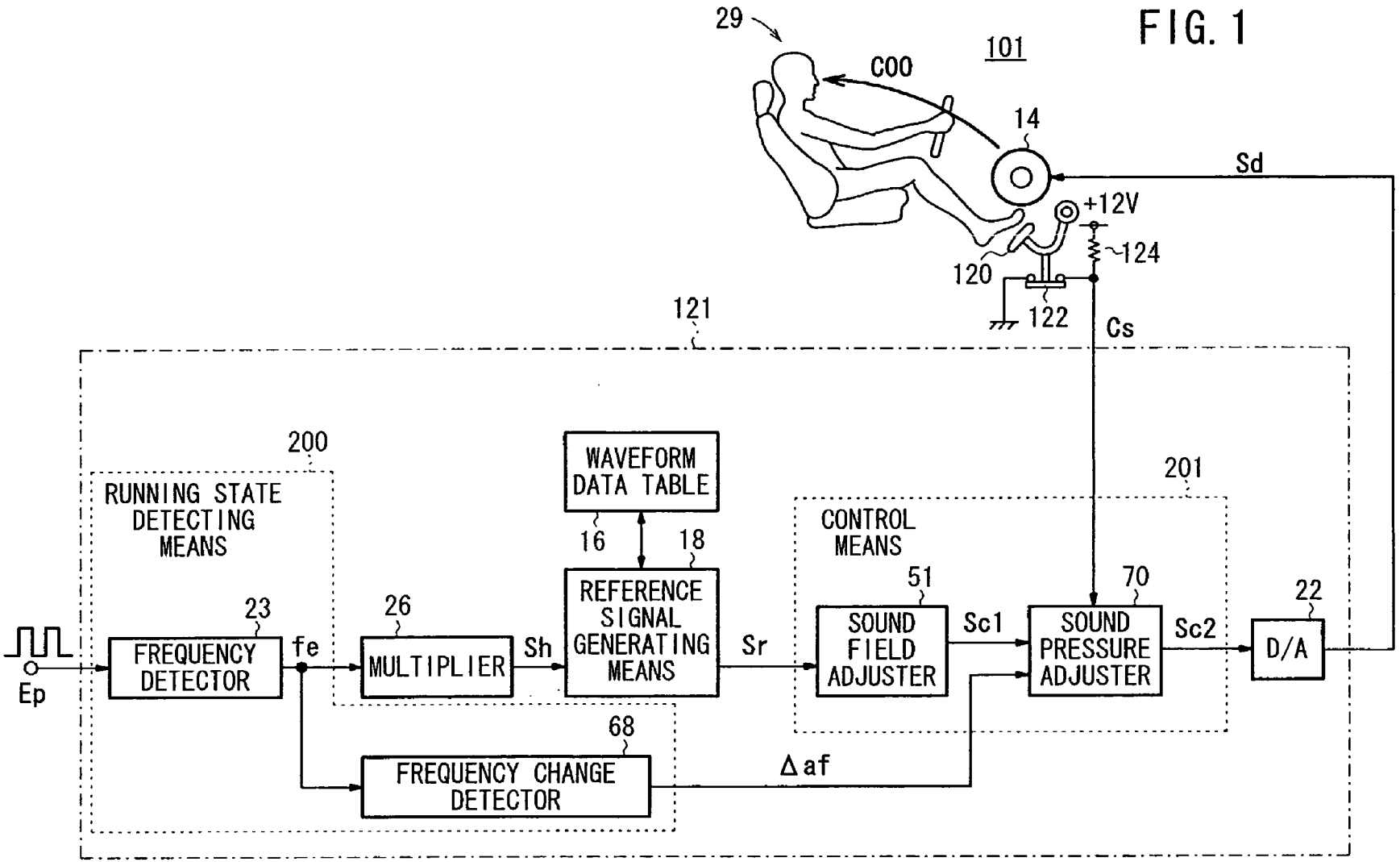
FIG. 1 is a block diagram of a vehicular sound effect generating apparatus according to an embodiment of the present invention.

FIG. 1 shows in block form a vehicular sound effect generating apparatus 101 according to an embodiment of the present invention.

As shown in FIG. 1, the vehicular sound effect generating apparatus 101, which is mounted on a motor vehicle, basically comprises a section in the form of an ECU (Electronic Control Unit) 121 serving as a general control means, a speaker 14 serving as an output means, and a clutch switch 122 for generating a clutch signal Cs when a clutch pedal 120 is depressed.

The clutch switch 122 comprises a normally closed switch having a fixed terminal grounded and another fixed terminal connected to a power supply of +12 [V] through a resistor 124. While the driver of the motor vehicle is depressing the clutch pedal 120, i.e., when the driver is disengaging the clutch or partly engaging the clutch, the clutch switch 122 has its movable contact kept out of contact with the fixed terminals and hence is open. While the clutch switch 122 is being open, a clutch signal Cs of +12 [V] is supplied from the clutch switch 122 to a sound pressure adjuster 70 of the ECU 121. When the ECU 121 is supplied with the clutch signal Cs of +12 [V], it recognizes that the motor vehicle incorporating the vehicular sound effect generating apparatus 101 is a motor vehicle with a manual transmission.

Before the ECU 121 is supplied with the clutch signal Cs of +12 [V], the ECU 121 recognizes according to a default setting that the motor vehicle incorporating the vehicular sound effect generating apparatus 101 is a motor vehicle with an automatic transmission, and controls the generation of a sound effect accordingly.

The section in the form of the ECU 121 is mounted in the dashboard of the motor vehicle, and basically has a waveform data table 16 for storing waveform data in one cyclic period, a reference signal generating means 18 for generating a reference signal Sr which has a harmonic (harmonic signal) Sh based on an engine rotation frequency fe of the motor vehicle by successively reading waveform data from the waveform data table 16, and a control means 201 for generating a control signal Sc2 based on the reference signal Sr.

The speaker 14 serves to apply sounds to a passenger in a passenger position 29 such as a driver seat or a front passenger seat. The speaker 14 is fixedly disposed on a panel in each of front doors on the opposite sides of the motor vehicle or on each of kick panels on the opposite sides of the motor vehicle, i.e., door-side inner panel surfaces alongside of a driver leg space. The speaker 14 may alternatively be disposed beneath the center of the dashboard.

The speaker 14 transduces a control signal Sd that is output from the control means 201 of the ECU 121 through a D/A converter 22 into a sound effect in the form of an acoustic signal, and outputs the sound effect. An output amplifier (not shown) is connected between the D/A converter 22 and the speaker 14, and has a gain variable by the passenger.

The reference signal generating means 18 has an input port connected to a series-connected circuit comprising a frequency detector 23 such as a frequency counter or the like for detecting the frequency of engine pulses Ep which are measured by a Hall-effect device or the like when the output shaft of the engine mounted on the motor vehicle rotates, and a multiplier 26 for outputting a harmonic signal Sh which has a frequency (sixth harmonic frequency) 6fe that is six times the engine rotation frequency fe (fundamental frequency) detected by the frequency detector 23. The multiplier 26 may multiply the engine rotation frequency fe by an integer such as 2, 3, 4, 5, 6, . . . or a real number such as 2.5, 3.3, . . . . The frequency detector 23 is included in a running state detecting means 200.

Between the speaker 14 and the passenger position (front-seat passenger position) 29, there are provided inherent acoustic characteristics (sound-field characteristics, frequency transfer characteristics, or sound-field gain characteristics) C00 due to the passenger cabin structure of the motor vehicle, the materials used in the passenger cabin of the motor vehicle, etc. The sound-field gain characteristics C00 have complex disturbances such as peaks and dips in the responses thereof because of the passenger cabin structure, the materials used, etc.

The sound-field gain characteristics C00 are obtained as gain frequency characteristics (hereinafter simply referred to as gain characteristics or frequency characteristics) representing the ratio of the amplitude (magnitude) to frequency of a signal that is output from a microphone which serves as a sound detecting means disposed in the front seat passenger position 29, or specifically at the position of an ear of the passenger in the front seat passenger position 29, when the frequency of a sine-wave signal having a constant amplitude that is applied as the control signal Sd to the speaker 14 is continuously varied from lower to higher frequencies. The frequency of a sine-wave signal, which is referred to above, is not the engine rotation frequency, but the frequency of an acoustic signal.

Stated otherwise, the sound-field gain characteristics C00 represent gain characteristics obtained at the front seat passenger position 29 when the reference signal generating means 18 and the D/A converter 22 are directly connected to each other, without the control means 201 interposed therebetween, and the frequency of a sine-wave signal having a constant amplitude that is generated by the reference signal generating means 18 is continuously varied from a lower frequency such as several tens [Hz] to a higher frequency such as 1 [kHz]. The gain represented by the gain characteristics C00 changes depending on the frequency of the reference signal Sr from the speaker 14 to the front seat passenger position 29. More strictly, the gain represented by the gain characteristics C00 changes depending on the frequency of the reference signal Sr from the reference signal generating means 18 to the front seat passenger position 29.

Figure 2A:
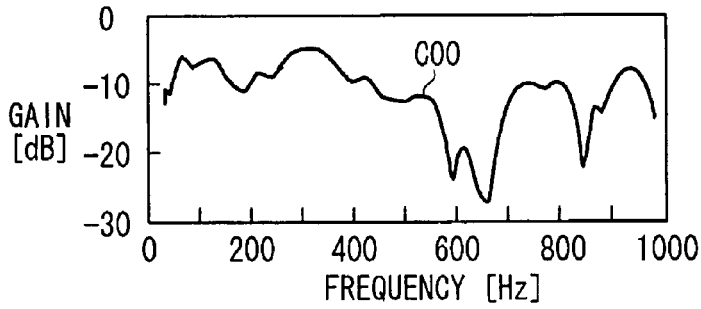
FIG. 2A is a diagram showing a measured gain characteristic curve.

FIG. 2A shows a gain characteristic curve C00, actually measured in a frequency range from about 30 [Hz] to about 970 [Hz], which represents sound-field characteristics from the position of the speaker 14 to the front seat passenger position 29, or more exactly to the ears of the passenger. The horizontal axis of FIG. 2A represents frequencies [Hz] and the vertical axis gains [dB]. It can be seen from FIG. 2A that gain characteristic curve C00 has complex disturbances such as peaks and dips.

The reference signal Sr is generated as follows: The waveform data table 16 is stored in a memory.

Figures 3A, 3B:
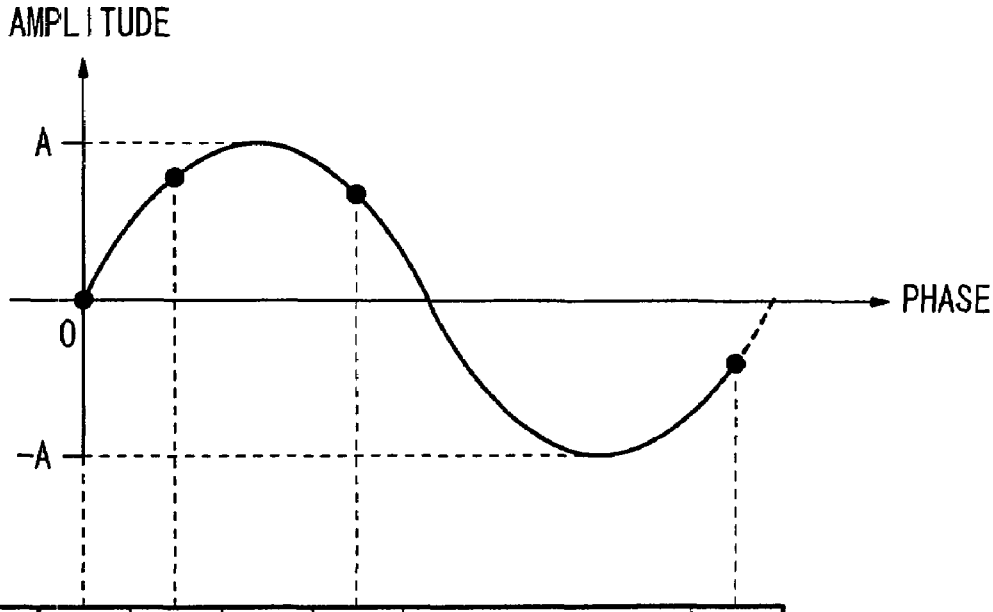
FIG. 3A is a diagram showing waveform data stored in a waveform data memory of the vehicular sound effect generating apparatus.
FIG. 3B is a diagram showing a sine wave which is generated by referring to the waveform data memory.

As schematically shown in FIGS. 3A and 3B, the waveform data table 16 comprises instantaneous value data stored as waveform data at respective addresses, the instantaneous value data representing a predetermined number (N) of instantaneous values into which the waveform of a sine wave in one cyclic period is divided at equal intervals along a time axis (=phase axis). The addresses (i) are indicated by integers (i=0, 1, 2, . . . , N-1) ranging from 0 to (the predetermine number-1). The alphabetical letter A shown in FIGS. 3A and 3B is represented by 1 or any desired positive real number. Therefore, the waveform data at the address i is calculated as A sin(360°×i/N). Stated otherwise, one cycle of sine waveform is divided into N sampled values at sampling points spaced over time, and data generated by quantizing the instantaneous values of the sine wave at the respective sampling points are stored as waveform data at respective addresses, which are represented by the respective sampling points, in the memory.

The reference signal generating means 18 generates a reference signal Sr, which comprises a sine-wave signal having a frequency corresponding to the frequency of the harmonic signal Sh, when the reference signal generating means 18 reads the waveform data from the waveform data table 16 while changing the readout address period depending on the period of the harmonic signal Sh that is applied to the reference signal generating means 18.

The control means 201 acoustically changes the reference signal Sr into a control signal Sc2 and outputs the control signal Sc2. The control means 201 comprises a sound field adjuster 51 and the sound pressure adjuster 70, each serving as an acoustic correcting means.

Figure 2B:
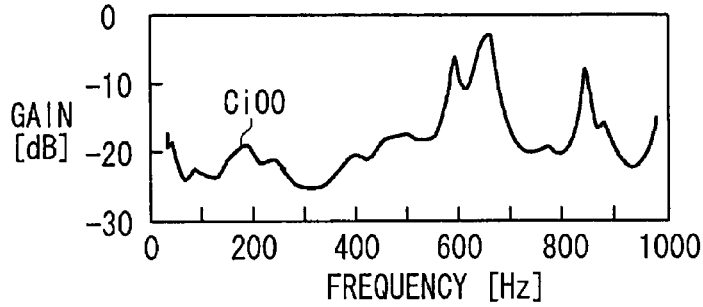
FIG. 2B is a diagram showing a gain characteristic curve which is an inversion of the measured gain characteristic curve.

As one of the acoustic correcting means, the sound field adjuster 51 functions as a filter whose gain characteristics (having a horizontal axis representing frequencies and a vertical axis representing gains) are represented by a gain characteristic curve (inverted gain characteristic curve) Ci00 shown in FIG. 2B which is an inversion of the gain characteristic curve C00 shown in FIG. 2A that changes depending on the frequency of the reference signal Sr from the speaker 14 to the front seat passenger position 29.

The inverted gain characteristic curve Ci00 is such a gain characteristic curve that it has an increased gain level at frequencies where acoustically less transmissive dips are present in the gain characteristic curve C00 shown in FIG. 2A and a reduced gain level at frequencies where acoustically more transmissive peaks are present in the gain characteristic curve C00 shown in FIG. 2A. The inverted gain characteristic curve Ci00 is expressed by an equation (transfer function) as Ci00=B/C00 where B represents a reference value.

Figure 2C:
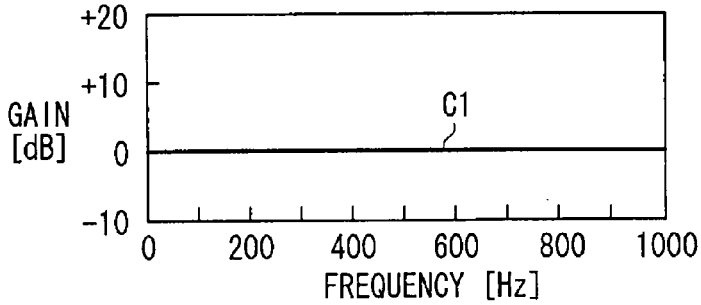
FIG. 2C is a diagram showing a corrected gain characteristic curve.

If the sound pressure adjuster 70 has a gain 1, i.e., 0 [dB], then the reference signal generating means 18 of the vehicular sound effect generating apparatus 101 generates a reference signal Sr having a constant amplitude in a frequency range from 30 [Hz] to 970 [Hz], the corrective gain characteristic curve Ci00 of the sound field adjuster 51 and the sound-field gain characteristic curve C00 are multiplied, producing gain characteristics C1 according to which sounds having a flat sound pressure level in the frequency range are heard at the front seat passenger position 29, as indicated by a gain characteristic curve C1 in FIG. 2C.

Therefore, when the cyclic period of the engine pulses Ep changes or remains constant as the passenger accelerates or decelerates the motor vehicle or keeps the motor vehicle running at a constant speed, the reference signal generating means 18 generates a sine-wave reference signal Sr whose frequency increases, decreases, or remains constant substantially in real time, depending on the harmonic signal Sh having a sixth-harmonic frequency 6 fe produced by the multiplier 26 from the engine rotation frequency fe that is detected by the frequency detector 23.

The reference signal Sr is converted into a control signal Sc1 that has been corrected by the gain characteristic curve Ci00 of the sound field adjuster 51. If the gain characteristic curve of the sound pressure adjuster 70 changes 0 [dB] regardless of frequency ranges, i.e., remains flat, then the sound effect output from the speaker 14 is prevented from changing depending on the frequency at the front seat passenger position 29 due to the vehicle cabin acoustic characteristics C00. Therefore, flat gain vs. frequency characteristics are available at the front seat passenger position 29. The sound effect generated at the front seat passenger position 29 is thus made linear depending on the engine rotational speed (six times the engine rotation frequency fe), or stated otherwise depending on the state of the noise source.

Figure 4:
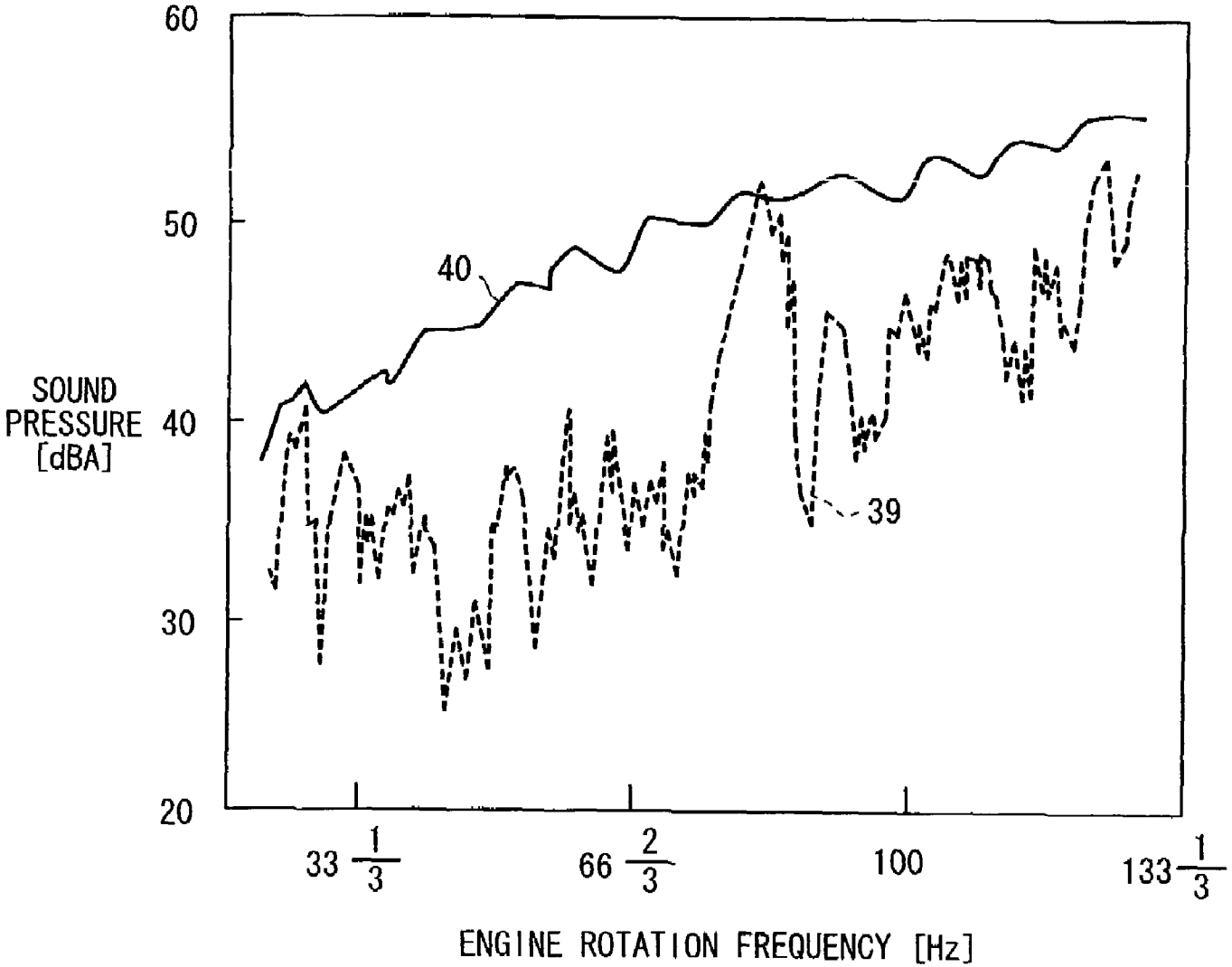
FIG. 4 is a diagram showing the frequency characteristics of sound pressure levels before and after they are corrected.

FIG. 4 shows actual frequency characteristics of sound pressure levels at the front seat passenger position 29 before and after they are corrected. To make the sound effect more linear in achieving the frequency characteristics shown in FIG. 4, the reference signal Sr or the control signal Sc is generated so as to have its amplitude increasing in proportion to the engine rotation frequency fe.

As shown in FIG. 4, a corrected characteristic curve 40 has its sound pressure level [dBA] changing more linearly depending on the engine rotation frequency fe than an uncorrected characteristic curve 39 having complex disturbances such as dips and peaks.

The process, referred to above for generating at the front seat passenger position 29 the sound effect which changes linearly as the engine rotation frequency fe increases or the motor vehicle is accelerated, will be referred to herein as a sound field adjusting process or a flattening process.

Figure 2D:
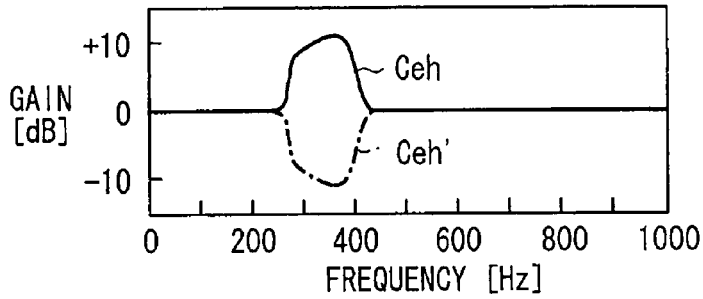
FIG. 2D is a diagram showing a gain characteristic curve with enhanced gains in a certain frequency range.
Figure 2E:
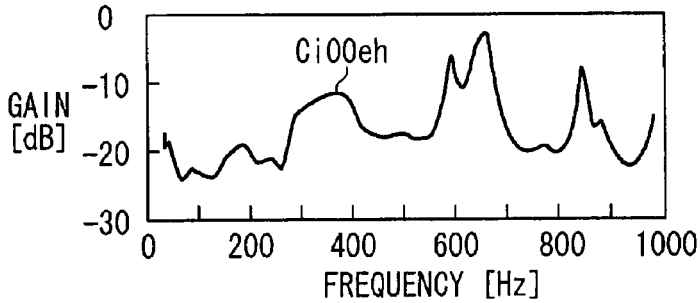
FIG. 2E is a diagram showing the inverted gain characteristic curve with enhanced gains in the certain frequency range.

The sound field adjuster 51 provides a joint gain characteristic curve Ci00*eh* by joining a gain characteristic curve Ceh having increased gains in a certain frequency range, e.g., a frequency range from 300 [Hz] to 450 [Hz], for example, as indicated by the solid line in FIG. 2D, and the gain characteristic curve Ci00, as shown in FIG. 2E. The joint gain characteristic curve Ci00*eh* shown in FIG. 2E has higher gains, i.e., produces higher sound pressure levels, in the frequency range from 300 [Hz] to 450 [Hz] than the inverted gain characteristic curve Ci00 shown in FIG. 2B.

The sound field adjuster 51 may provide a gain characteristic curve Ceh' indicated by the dotted line in FIG. 2D at the front seat passenger position 29 for thereby reducing gains or lowering sound pressure levels in the above frequency range. The process referred to above for emphasizing an acoustic signal only at desired frequencies is referred to as a frequency emphasizing process.

The vehicular sound effect generating apparatus 101 also has a frequency change detector 68 for determining a frequency change Δaf [Hz/sec] per unit time of the engine rotation frequency fe, in order to operate the sound pressure adjuster 70 as the other acoustic correcting means. The frequency change detector 68 is included in the running state detecting means 200.

The sound pressure adjuster 70 has gain characteristics 72 (output gain characteristics, acoustic correcting characteristics, or gain characteristic curve(s)), which will be described in detail below, depending on the frequency change Δaf. The sound pressure adjuster 70 corrects the control signal Sc1 supplied from the sound field adjuster 51 according to the gain characteristics 72, and outputs a corrected control signal Sc2 through the D/A converter 22 to the speaker 14 near a front seat.

Figure 5:
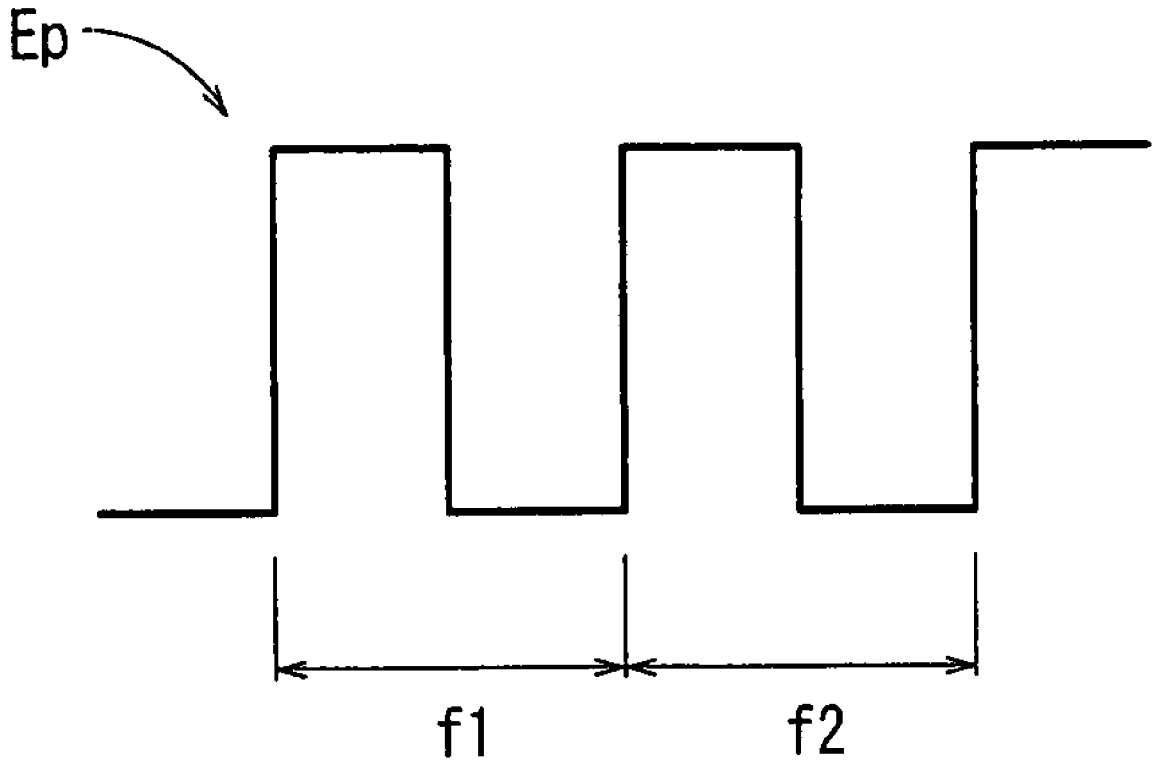
FIG. 5 is a diagram showing the waveform of engine pulses.

FIG. 5 shows the waveform of engine pulses Ep. For determining a frequency change Δaf, the frequency change detector 68 determines the difference Δf (Δf=f2−f1) between the frequencies of two successive pulses, i.e., the frequency f1 of a preceding pulse (preceding frequency) and the frequency f2 of a following pulse (present frequency), which are successively detected by the frequency detector 23. The frequency change detector 68 multiplies the difference Δf by the present frequency f2 to determine a frequency change Δaf (Δaf=Δf×f2) [Hz/sec] per unit time of the engine rotation frequency fe, i.e., to determine an acceleration.

It is known in the art that the frequency change Δaf has a different value depending on which gear position the transmission of the motor vehicle is in. Specifically, the frequency change Δaf is greater when the transmission is in a lower gear position and is smaller when the transmission is in a higher gear position.

Generally, the sound level of the sound effect depending on the frequency change Δaf should preferably be greater in a lower gear position than in a higher gear position. The sound level of the sound effect should preferably be lower when the motor vehicle cruises at a constant speed or is decelerated. Furthermore, the sound level of the sound effect should preferably be lower such that it will not produce uncomfortable sounds when the engine is raced or operates on kickdown with the frequency change exceeding a frequency level for full throttle opening at the first gear position.

Figure 6:
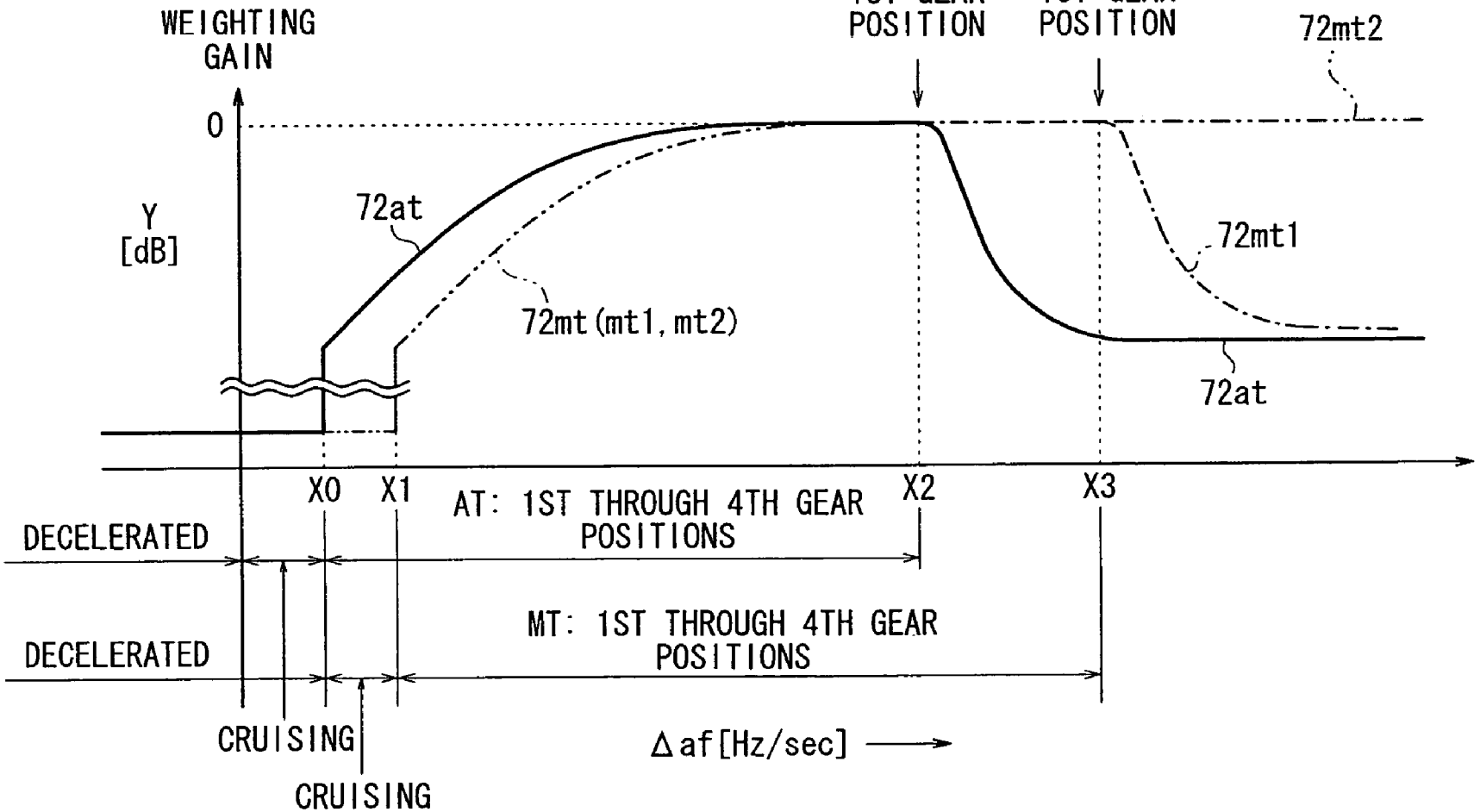
FIG. 6 is a diagram showing weighting gain characteristic curves that are set in a sound pressure adjuster.

FIG. 6 shows weighting gain characteristic curves 72 that are set as acoustic correcting characteristic curves in the sound pressure adjuster 70 in view of the above considerations.

As shown in FIG. 6, the weighting gain characteristic curves 72 include a weighting gain characteristic curve 72*at* that is applied to an AT vehicle with an automatic transmission and weighting gain characteristic curves 72mt1, 72mt2 that are applied to an MT vehicle with a manual transmission.

Figure 9:
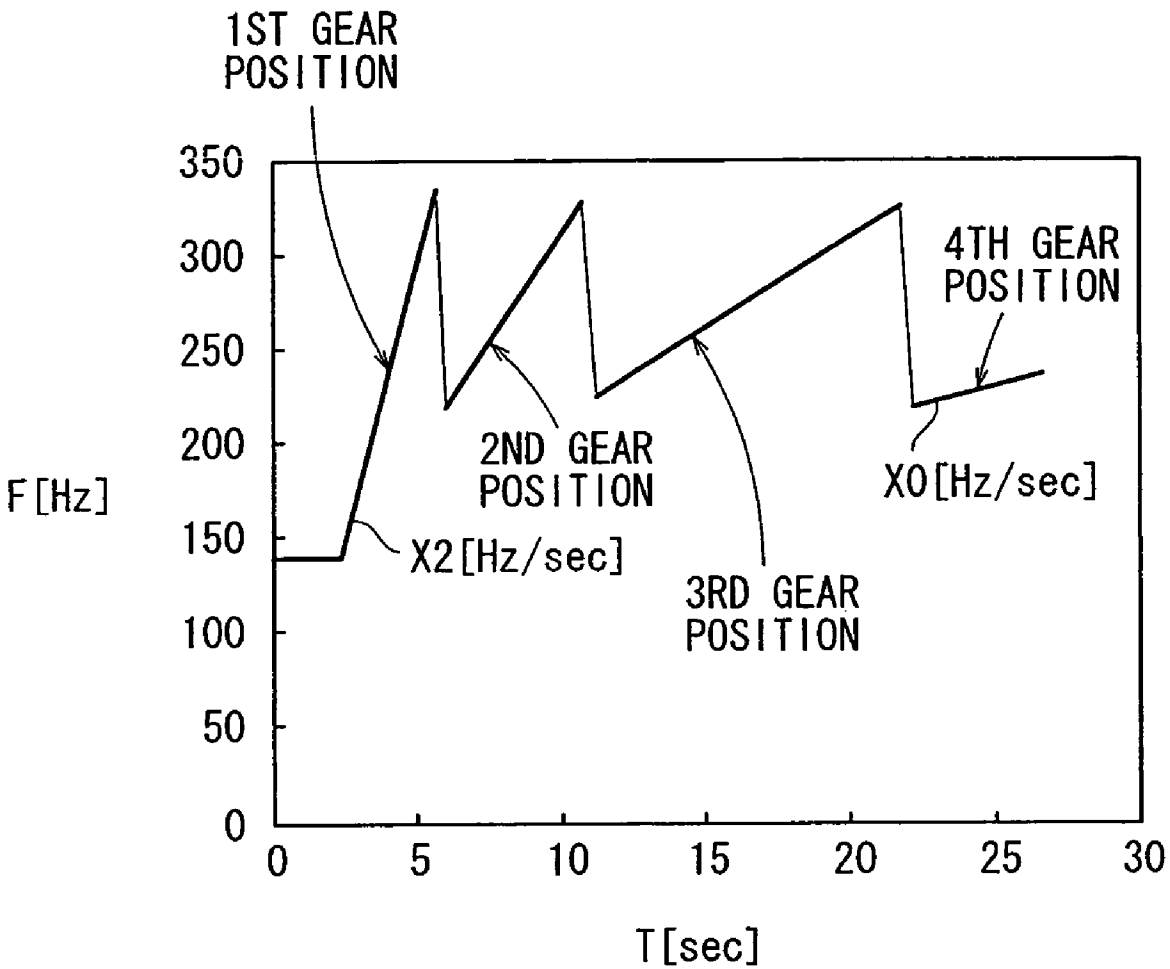
FIG. 9 is a diagram showing rotational frequency changes on a motor vehicle powered by a six-cylinder engine with an automatic transmission (AT motor vehicle).

According to the weighting gain characteristic curve 72*at* applied to the AT vehicle, the weighting gain Y is set to 0 [dB] at a frequency change X2 (see FIG. 9) for full throttle opening at the first gear position, and is progressively smaller up to a frequency change X0 (see FIG. 9) for full throttle opening at the fourth gear position as the frequency change Δaf becomes smaller from the frequency change X2 for full throttle opening at the first gear position. Specifically, a larger sound effect is produced when the vehicle is accelerated at a lower gear position, and a smaller sound effect is produced when the vehicle is accelerated at a higher gear position. The weighting gain Y is minimum when the vehicle is cruising or decelerated. When the engine is raced or operates on kickdown with the frequency change Δaf exceeding the frequency change X2 for full throttle opening at the first gear position, the weighting gain Y is quickly lowered so as not to produce an uncomfortable sound effect.

Figure 8:
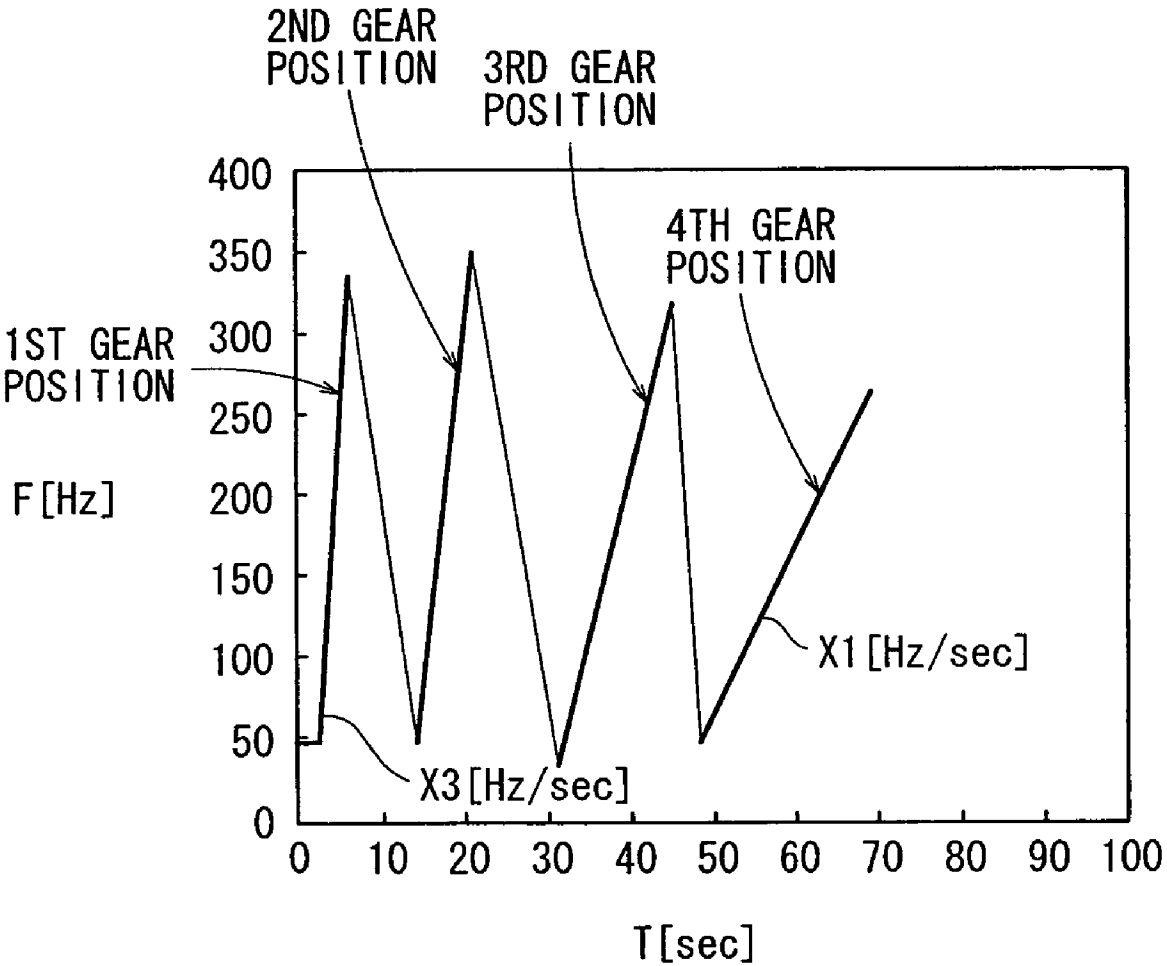
FIG. 8 is a diagram showing rotational frequency changes on a motor vehicle powered by a six-cylinder engine with a manual transmission (MT motor vehicle)

According to the weighting gain characteristic curves 72mt1, 72mt2 applied to the MT vehicle, the weighting gain Y is set to 0 [dB] at a frequency change X3 (see FIG. 8) for full throttle opening at the first gear position, and is progressively smaller up to a frequency change X1 (see FIG. 8) for full throttle opening at the fourth gear position as the frequency change Δaf becomes smaller from the frequency change X3 for full throttle opening at the first gear position. As with the AT vehicle, a larger sound effect is produced when the vehicle is accelerated at a lower gear position, and a smaller sound effect is produced when the vehicle is accelerated at a higher gear position. The weighting gain Y is minimum when the vehicle is cruising or decelerated. When the engine is raced or operates on kickdown with the frequency change Δaf exceeding the frequency change X3 for full throttle opening at the first gear position, the weighting gain characteristic curve 72mt1 with the weighting gain Y being quickly lowered so as not to produce an uncomfortable sound effect or the weighting gain characteristic curve 72mt2 with the weighting gain Y remaining unchanged can be selected. Normally, the weighting gain characteristic curve 72mt1 is selected.

Figure 7:
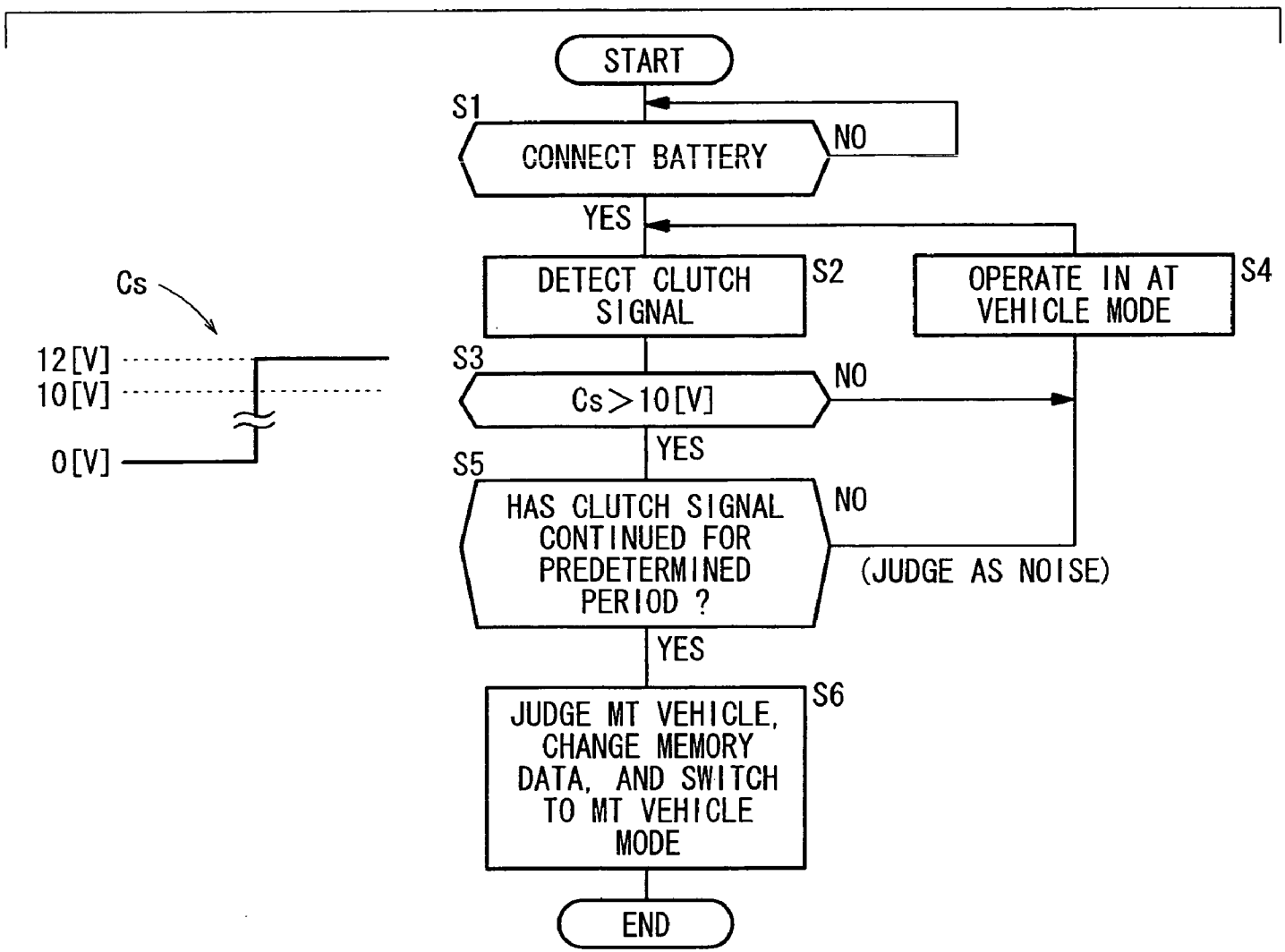
FIG. 7 is a flowchart of an operation sequence of the vehicular sound effect generating apparatus shown in FIG. 1.

The vehicular sound effect generating apparatus 101 is basically constructed as described above. A process, performed by the vehicular sound effect generating apparatus 101, of automatically setting how a sound effect is to be generated depending on whether the motor vehicle is fitted with a manual transmission or an automatic transmission will be described below with reference to a flowchart shown in FIG. 7.

In step S1, a battery, not shown, is connected to the ECU 121. In step S2, the ECU 121 detects a clutch signal Cs.

In step S3, the ECU 121 determines whether the voltage of the clutch signal Cs exceeds a threshold voltage of 10 [V] or not. If the voltage of the clutch signal Cs is equal to or lower than 10 [V], then the ECU 121 judges that the motor vehicle is fitted with an automatic transmission. Then, in step S4, the ECU 121 operates in an AT vehicle mode, i.e., generates a control signal Sc2 by acoustically changing the control signal Sc1 according to the weighting gain characteristic curve 72*at* applied to the AT vehicle which is set as the default setting in the sound pressure adjuster 70.

If the clutch signal Cs of +12 [V] is not detected, therefore, the vehicular sound effect generating apparatus 101 generates a sound effect weighted by the weighting gain characteristic curve 72*at* (see FIG. 6) applied to the AT vehicle which is written in advance in a memory such as an unillustrated EEPROM or the like.

If the voltage of the clutch signal Cs exceeds the threshold voltage of 10 [V] in step S3, then the ECU 121 determines whether the voltage of the clutch signal Cs in excess of the threshold voltage of 10 [V] has continued for a predetermined period of time or not in step S5. If the voltage of the clutch signal Cs in excess of the threshold voltage of 10 [V] has not continued for the predetermined period of time, then the ECU 121 judges that the voltage of the clutch signal Cs has been caused by noise, and continues to operate in the AT vehicle mode in step S4. If the voltage of the clutch signal Cs in excess of the threshold voltage of 10 [V] has continued for the predetermined period of time, then the ECU 121 judges that the clutch signal Cs of +12 [V] is detected because the clutch switch 122 is opened by the clutch pedal 120 depressed by the driver, and that the motor vehicle is fitted with a manual transmission instead of an automatic transmission in step S6.

The ECU 121 switches from the weighting gain characteristic curve 72*at* applied to the AT vehicle which is stored in the memory to the weighting gain characteristic curve 72mt1 (see FIG. 6) applied to the MT vehicle which is also stored in the memory such as an EEPROM.

If the clutch signal Cs of +12 [V] is detected continuously for the predetermined period of time, the vehicular sound effect generating apparatus 101 operates in an MT vehicle mode and generates a sound effect weighted by the weighting gain characteristic curve 72mt1 applied to the MT vehicle.

According to the embodiment described above, the vehicular sound effect generating apparatus 101 has the waveform data table 16 for storing waveform data in one cyclic period, the reference signal generating means 18 for generating a reference signal Sr by successively reading waveform data from the waveform data table 16, the running state detecting means 200 for detecting a running state of the vehicle, the control means 201 having the sound pressure adjuster 70 as an acoustic correcting means storing the weighting gain characteristic curves 72 as acoustic correcting characteristic curves depending on the frequency change Δaf [Hz/sec] which represents the running state of the vehicle, i.e., a time-dependent change of the engine rotation frequency fe in the present embodiment, for generating a control signal Sc2 by acoustically changing the reference signal Sr depending on the frequency change Δaf detected by the running state detecting means 200, and the speaker 14 as an output means for outputting the control signal Sc2 as a sound effect.

The control means 201 has a transmission determining means (steps S2, S3, S5) for determining whether the transmission on the vehicle is a manual transmission or an automatic transmission. Depending on the transmission determined by the transmission determining means, the control means 201 automatically changes the weighting gain characteristic curves 72 as acoustic correcting characteristic curves stored in the sound pressure adjuster 70. Specifically, the control means 201 determines whether the transmission on the vehicle is a manual transmission or an automatic transmission depending on whether the clutch signal Cs of +12 [V] has continued for a predetermined period of time or not. Therefore, the vehicular sound effect generating apparatus 101 is of a relatively simple arrangement and can generate an appropriate sound effect depending on whether the transmission on the vehicle is a manual transmission or an automatic transmission.

The control means 201 of the ECU 121 stores in its ROM the weighting gain characteristic curve 72*at* applied to an AT vehicle with an automatic transmission and the weighting gain characteristic curves 72mt1, 72mt2 applied to an MT vehicle with a manual transmission. The vehicular sound effect generating apparatus 101 can thus be manufactured and maintained at a relatively low cost because it does not need to have different ECUs operable respectively for AT and MT vehicles of the same type.

As shown in FIG. 6, the gain Y for the frequency change X3 for the automatic transmission when the engine is raced, which corresponds to the frequency change X3 for the manual transmission upon full throttle opening at the first gear position, is set to a value smaller than the gain Y of 0 [dB] for the frequency change X3 for the manual transmission for full throttle opening at the first gear position. Therefore, an appropriate sound effect is generated for the frequency change X3 for the manual transmission upon full throttle opening at the first gear position. Since a small sound effect is generated for the frequency change X3 for the automatic transmission when the engine is raced, which corresponds to the frequency change X3 for the manual transmission upon full throttle opening at the first gear position, the passengers are preventing from having an odd feeling about the sound effect generated in the vehicle cabin.

When the frequency change Δaf of the engine rotation frequency fe is greater than the frequency change X2 as a predetermined threshold, the weighting gain characteristic curves 72mt1, 72mt2 for the manual transmission are set to values greater than the weighting gain characteristic curve 72*at* for the automatic transmission. Consequently, when the frequency change Δaf of the engine rotation frequency fe is greater than the frequency change X2 for the automatic transmission upon full throttle opening at the first gear position, the MT vehicle with the manual transmission can generate a larger sound effect than the AT vehicle with the automatic transmission.

The clutch signal Cs of +12 [V] is produced each time the clutch pedal 120 is depressed. Therefore, the frequency change Δaf in excess of the value Y=X3 at the time the clutch signal Cs is generated is recognized as a transition state rather than an accelerated state, and the weighting gain Y is adjusted on the weighting gain characteristic curve 72mt1 wherein the weighting gain Y is reduced or the weighting gain characteristic curve 72mt2 wherein the weighting gain Y is not increased, but remains constant. Therefore, the sound pressure which makes the passengers feel odd about the sound effect can be reduced.

Although a certain preferred embodiment of the present invention has been shown and described in detail, it should be understood that various changes and modifications may be made therein without departing from the scope of the appended claims.

What is claimed is:

1. A vehicular sound effect generating apparatus comprising:

a waveform data table for storing waveform data in one cyclic period;

reference signal generating means for generating a reference signal by successively reading the waveform data from said waveform data table;

running state detecting means for detecting a running state of a vehicle;

control means having acoustic correcting means having acoustic correcting characteristics depending on the running state of the vehicle, for generating a control signal by using said acoustic correcting means by acoustically changing said reference signal depending on the running state of the vehicle detected by said running state detecting means;

output means for outputting said control signal as a sound effect; and transmission determining means for determining whether a transmission on the vehicle is a manual transmission or an automatic transmission;

wherein said control means changes said acoustic correcting characteristics of said acoustic correcting means depending on the transmission determined by said transmission determining means.

2. A vehicular sound effect generating apparatus according to claim 1, wherein said running state of said vehicle comprises an engine rotation frequency change; and said acoustic correcting characteristics comprise output gain characteristics corresponding to said engine rotation frequency change;

wherein when said engine rotation frequency change exceeds a predetermined threshold, the output gain characteristics for said manual transmission are set to values greater than the output gain characteristics for said automatic transmission.

3. A vehicular sound effect generating apparatus according to claim 2, wherein said predetermined threshold comprises an engine rotation frequency change for an AT vehicle fitted with the automatic transmission upon full throttle opening at a first gear position.

4. A vehicular sound effect generating apparatus according to claim 2, wherein if said transmission determining means judges that the transmission on the vehicle is a manual transmission, when said control means changes said acoustic correcting characteristics, said control means judges that the engine rotation frequency change in excess of an engine rotation frequency change for the manual transmission upon full throttle opening at a first gear position represents a transition state rather than an accelerated state, and sets the output gain characteristics to characteristics which are reduced as the engine rotation frequency change increases or characteristics which remain constant as the engine rotation frequency change increases.

5. A vehicular sound effect generating apparatus according to claim 2, wherein said control means is provided by an ECU which is shared by an AT vehicle having the automatic transmission and an MT vehicle having the manual transmission, said control means having a ROM storing output gain characteristics used by the AT vehicle having the automatic transmission and output gain characteristics used by the MT vehicle having the manual transmission.

* * * * *